US010156861B2

(12) United States Patent
Coimbra et al.

(10) Patent No.: US 10,156,861 B2
(45) Date of Patent: Dec. 18, 2018

(54) LOW-DROPOUT REGULATOR WITH POLE-ZERO TRACKING FREQUENCY COMPENSATION

(71) Applicant: NXP B.V., Eindhoven (NL)

(72) Inventors: Ricardo Coimbra, Campinas (BR); Javier Mauricio Olarte Gonzalez, Campinas (BR); Marcos Mauricio Pelicia, Campinas (BR)

(73) Assignee: NXP USA, Inc., Austin, TX (US)

( * ) Notice: Subject to any disclaimer, the term of this patent is extended or adjusted under 35 U.S.C. 154(b) by 0 days.

(21) Appl. No.: 15/213,606

(22) Filed: Jul. 19, 2016

(65) Prior Publication Data

US 2018/0024580 A1 Jan. 25, 2018

(51) Int. Cl.

| | |
|---|---|
| ***G05F 1/563*** | (2006.01) |
| ***G05F 1/575*** | (2006.01) |
| *G05F 1/59* | (2006.01) |

(52) U.S. Cl.

CPC ..... *G05F 1/575* (2013.01); *G05F 1/563* (2013.01); *G05F 1/59* (2013.01)

(58) Field of Classification Search

CPC ..... G05F 1/563; G05F 1/59; G05F 1/575
See application file for complete search history.

(56) References Cited

U.S. PATENT DOCUMENTS

| | | | | |
|---|---|---|---|---|
| 6,046,577 | A | 4/2000 | Rincon-Mora et al. | |
| 7,253,595 | B2 | 8/2007 | Oddoart et al. | |
| 7,875,996 | B2 | 1/2011 | Nguyen et al. | |
| 8,648,578 | B2 | 2/2014 | Zhao et al. | |
| 9,588,531 | B2 | 3/2017 | Pelicia et al. | |
| 2008/0116862 | A1* | 5/2008 | Yang | G05F 1/575 323/269 |
| 2009/0160256 | A1 | 6/2009 | Nguyen et al. | |
| 2009/0212753 | A1* | 8/2009 | Lou | G05F 1/563 323/277 |
| 2010/0277148 | A1 | 11/2010 | Zhao et al. | |
| 2011/0156671 | A1* | 6/2011 | Gakhar | G05F 1/563 323/280 |
| 2011/0193538 | A1* | 8/2011 | Arigliano | G05F 1/563 323/282 |

OTHER PUBLICATIONS

Torres, Joselyn et al; "Low Drop-out Voltage Regulator Capacitor-less Architecture Comparison;" IEEE Circuits and Systems Magazine, vol. 14, Issue 2, Published May 19, 2014 pp. 6-26; DOI: 10.1109/MCAS.2014.2314263.

* cited by examiner

*Primary Examiner* — Harry Behm

(57) ABSTRACT

An electronic device may include: a load and a voltage regulator coupled to the load and configured to provide a load current, where the voltage regulator includes a first and a second pass device coupled in parallel and configured to operate simultaneously. A method may include providing current to a load using a first and a second pass device coupled in parallel and configured to operate simultaneously, where the first device provides a first current corresponding to a high-frequency component and the second device provides a second current corresponding to a low-frequency component; in response to a decrease in a low-frequency component, causing the second current to decrease and causing the low-frequency component to increase; and in response to an increase in the low-frequency component, causing the second current to increase and causing the low-frequency component to decrease.

15 Claims, 9 Drawing Sheets

200

100

200

300

LOW-DROPOUT REGULATOR WITH POLE-ZERO TRACKING FREQUENCY COMPENSATION

FIELD

This disclosure relates generally to electronic circuits and devices, and more specifically, to a capacitor-less low-dropout (CL-LDO) regulator.

BACKGROUND

A low-dropout (LDO) voltage regulator is a DC linear voltage regulator that is capable of regulating an output voltage even when the supply voltage is near the output voltage. Advantages of an LDO regulator over other DC-to-DC regulators include the absence of switching, smaller size, and design simplicity.

A capacitor-less low-dropout (CL-LDO) voltage regulator corresponds to a LDO voltage regulator that does not require an off-chip capacitor to achieve stability. Advantages of a CL-LDO regulator over conventional LDO regulators include the lower number of external components and PCB area thereby reducing total cost of the system.

In some applications, an LDO regulator may be used to regulate a voltage applied to the logic gates of a Sea-of-Gates (SoG). In those cases, CL-LDOs regulator solutions may be desired in order to lower total cost of the system.

Therefore, the inventors hereof have recognized a need for a capacitor-less LDO regulator for logic circuits with improved transient performance and power-efficiency while supporting a wide load current range. An SoG load profile includes a dynamic current resulting from logic switching activity (fast-speed), and a leakage current that is mainly dependent on operating temperature (slow-speed). The leakage component can range from a negligible value at low temperatures to values several times higher than the dynamic component at high temperatures. Furthermore, low-power operation modes that employ power and/or clock-gating techniques can also extend the load range requirements in a way that conventional LDO regulators cannot satisfy.

BRIEF DESCRIPTION OF THE DRAWINGS

The present invention(s) is/are illustrated by way of example and is/are not limited by the accompanying figures, in which like references indicate similar elements. Elements in the figures are illustrated for simplicity and clarity and have not necessarily been drawn to scale.

DETAILED DESCRIPTION

Systems and methods for a capacitor-less low-dropout (CL-LDO) regulator with pole-zero tracking frequency compensation are disclosed. In various embodiments, a capacitor-less LDO architecture is provided with improved transient performance over a wide range of load currents. Frequency compensation may be obtained through the inclusion of a pole-zero pair with the zero tracking (cancelling the effect of) the output node pole.

Figure 1:
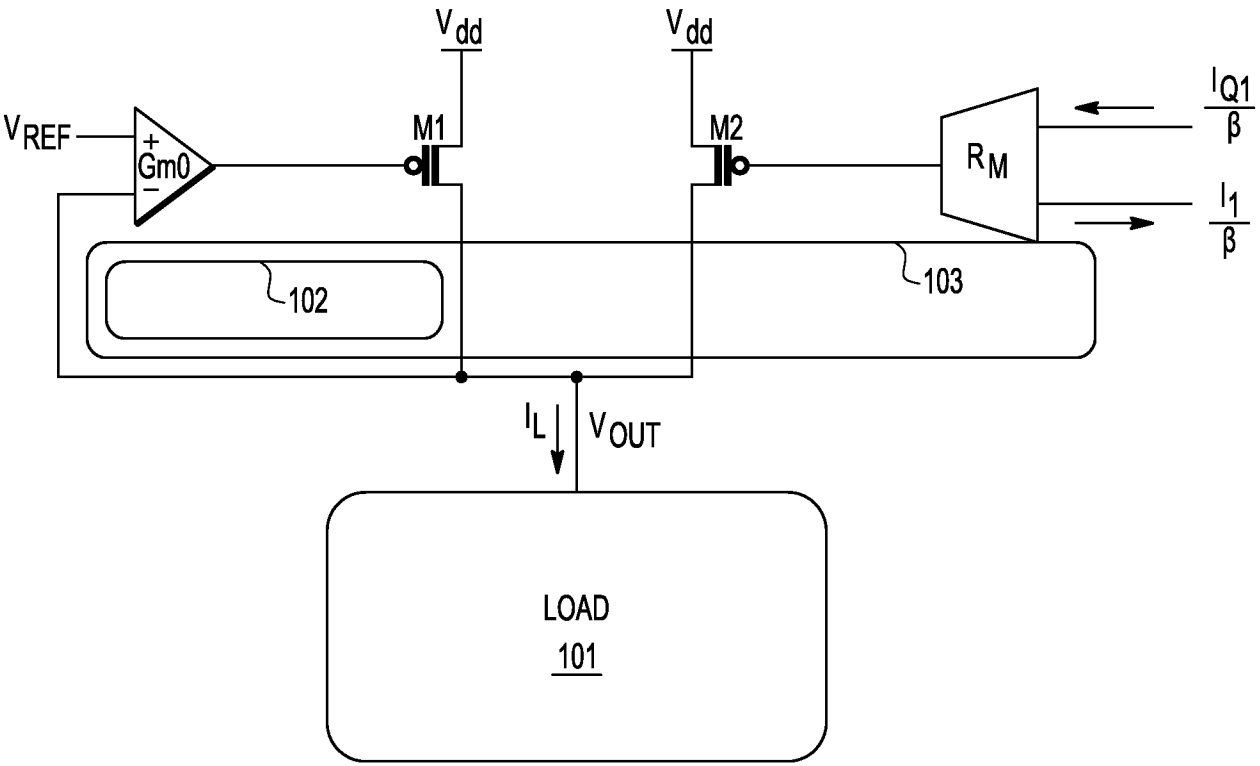
FIG. 1 is a circuit diagram of an example of a capacitor-less low-dropout (CL-LDO) voltage regulator according to some embodiments.

Turning to FIG. 1, a circuit diagram of CL-LDO regulator architecture 100 is depicted according to some embodiments. An LDO regulator architecture, described herein, may include two pass-devices M1 and M2 connected in parallel to LDO regulator's output node ($V_{OUT}$): a first, small pass-device M1 that reacts to fast load current variations and a second, large pass-device M2 that reacts to slow load current variations. Architecture 100 also includes operational amplifier ($G_{m0}$) and transresistance amplifier ($R_M$). Feedback control may be obtained using two closed-loop structures 102 and 103.

The first closed-loop structure 102 may resemble a conventional LDO regulator built around the small pass-device M1. This first loop 102 ("first" or "fast closed-loop") may have a dominant pole at the output node ($V_{OUT}$) and may provide high-speed response to fast load 101 transients.

The second closed-loop structure 103 ("second" or "slow closed-loop") may include both small and large pass-devices (e.g., M2), may have an internal dominant pole (typically at the gate node of the large pass-device), and may provide a high current capability at low frequencies. This second loop 103 may operate to maintain a fixed quiescent current level through the small pass-device while directing all exceeding, low-frequency current components to the large pass-device.

A current $I_1/\beta$ provides a mirrored copy of $I_1$ reduced by scaling factor $\beta$, and a second current $I_{Q1}/\beta$ provides reference or quiescent current $I_{Q1}$, also reduced by the same factor $\beta$. The difference between second current $I_{Q1}/\beta$ and first current $I_1/\beta$ is applied to the gate terminal of M2. Moreover, the output current of transconductance element $G_{m0}$ is proportional to the difference between reference voltage $V_{REF}$ and output voltage $V_{OUT}$. These, and other features of LDO regulator architecture 100 are discussed in connection with various illustrative implementations discussed below.

Figure 2:
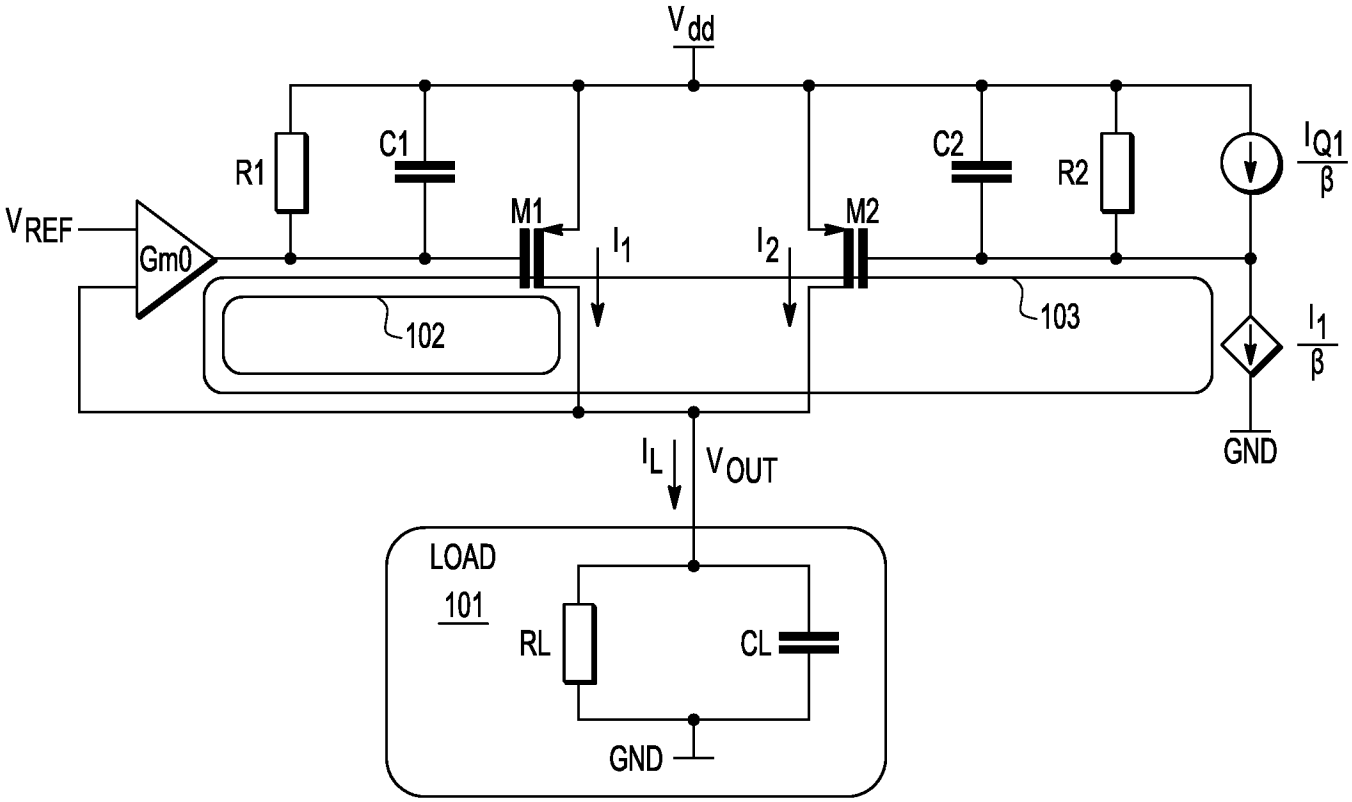
FIG. 2 is a circuit diagram of an example of the CL-LDO voltage regulator of FIG. 1 with illustrative amplifier implementations, according to some embodiments.

Turning to FIG. 2, a circuit diagram with an example of a CL-LDO voltage regulator 200 with implementations of operational amplifier ($G_{m0}$) and transresistance amplifier ($R_M$) shown in FIG. 1, according to some embodiments. As illustrated in this case, LDO regulator 200 provides voltage $V_{OUT}$ at an output node, and load 101 draws load current $I_L$ from that node. Load 101 includes impedance RL and capacitance CL in parallel with each other and coupled to a reference or ground (GND), representing characteristics of any logic circuit and/or Sea-of-Gates (SoG) design that is coupled to LDO regulator 200.

LDO regulator 200 includes two pass devices M1 and M2 (here illustrated as PMOS transistors but the same topology can be built using NMOS output transistor) in parallel with each other and configured to operate concurrently or simultaneously, providing currents $I_1$ and $I_2$, respectively, such that load current $I_L$ at the output node is the sum of $I_1$ with $I_2$. The source terminals of M1 and M2 are coupled to a voltage supply rail ($V_{dd}$), and the drain terminals of M1 and M2 are coupled to the output node ($V_{OUT}$) of LDO regulator 200.

On M1's side, the gate terminal of M1 is coupled to the output of a transconductance element ($G_{m0}$). Resistor R1 in parallel with capacitor C1 represents the impedance at the gate of M1. Capacitor C1 represents the total capacitance between the gate of M1 and the Vdd supply rail, which includes the parasitic source-to-gate capacitance of M1, other parasitic capacitances, and any integrated capacitor included. Alternatively, C1 may represent the total capacitance between the gate of M1 and low-impedance nodes (AC grounds). And still alternatively, C1 may also represent an equivalent input capacitance between the gate of M1 and any other node where an inverting voltage gain relation (related to gate voltage) is present. Resistor R1 represents the DC output impedance of $G_{m0}$ in parallel with any resistive element that may be included. In some cases, transconductance element $G_{m0}$ may be implemented, for example, as an operational transconductance amplifier (OTA), as a differential pair, or as a single transistor used as a transconductor. In an AC analysis, the output current of transconductance element $G_{m0}$ is proportional to the difference between reference voltage $V_{REF}$ and output voltage $V_{OUT}$.

On M2's side, resistor R2 in parallel with capacitor C2 represent the impedance at the gate of M2. Capacitor C2 represents the total capacitance between the gate of M2 and the Vdd supply rail, which comprises any capacitive element included, and/or the parasitic capacitances such as the source-to-gate parasitic capacitance of M2. Alternatively, C2 may represent the total capacitance between the gate of M2 and low-impedance nodes (AC grounds). And still alternatively, C2 may also represent an equivalent input capacitance between the gate of M2 and any other node where an inverting voltage gain relation (related to gate voltage) is present. The gate of M2 is driven as a result of comparing current I1 delivered by M1 with a design-defined current $I_{Q1}$, as exemplified in FIG. 2. A first current source $I_1/\beta$ provides a mirrored copy of $I_1$ and/or its low-frequency component, reduced by scaling factor β. And a second current source $I_{Q1}/\beta$ provides reference or quiescent current $I_{Q1}$, also reduced by the same factor β. The difference between second current source $I_{Q1}/\beta$ and first current source $I_1/\beta$ is applied to the gate terminal of M2.

When load 101 is in operation, for the purpose of analysis, current $I_L$ is divided in a low-frequency (slow varying) component and a high-frequency (fast varying) component. In cases such as when load 101 includes the logic gates of a Sea-of-Gates, the value of the low-frequency (near static) component may become several times greater than that of the high-frequency (dynamic) component especially when leakage currents dominate. In various embodiments, M1's current $I_1$ is designed to provide the high-frequency component of $I_L$ (small and fast), whereas M2's current $I_2$ supply the low-frequency component of $I_L$ (large and slow).

First closed-loop 102 controls first pass device M1 and second closed-loop 103 controls second pass device M2. In an initial state where $I_L$ is smaller than $I_{Q1}$, second closed-loop 103 turns pass device M2 off and $I_2$ is zero. Only first closed-loop 102 is active and M1's current $I_1$ is equal to $I_L$. As $I_L$ increases, however, $I_1$ reaches and then overcomes $I_{Q1}$ and second closed-loop 103 turns on. At this stage, both control loops 102 and 103 are operating. From this point on, second closed-loop 103 causes the low frequency component of M1's current $I_1$ to stabilize and keep the same value as $I_{Q1}$ while the remainder of the low-frequency component of $I_L$ is provided by M2's current $I_2$. Then, M1 may provide a fast varying I1 current (high-frequency component of IL) having DC offset level maintained at $I_{Q1}$.

In various implementations, second closed-loop 103 is made capable of providing greater output currents than first closed-loop 102. The size (e.g., aspect ratio) of M2 is larger than that of M1, and second closed-loop 103 has a slower response than first closed-loop 102.

In summary, current $I_1$ provided by pass device M1 is designed to address fast and relatively small variations in $I_L$. Second closed-loop 103, in a slower fashion, adjusts the value of $I_2$ to supply the slow-varying and larger component of $I_L$ and to cause $I_1$ to have an low-frequency component centered around $I_{Q1}$. In response to fast variations in load current $I_L$, the value of current $I_1$ varies around $I_{Q1}$ and supplies the fast transient components of $I_L$. Current $I_2$ trails behind $I_1$ continuously adjusting DC offset level of $I_1$ to match $I_{Q1}$. In various implementations, the value of $I_{Q1}$ may be set reasonably above the maximum instantaneous load current step or peak required to be supported by that application.

As a non-limiting example, assume an initial state where $I_L$ is equal to 3 mA, M1 provides current $I_1$ equal to 1.5 mA, and M2 provides current $I_2$ equal to 1.5 mA. Also, assume that $I_L$ is subject to step variations of as much as 1 mA in each direction; that is, $I_L$ can vary between 2 mA and 4 mA very quickly. The choice of $I_{Q1}$ should be sufficiently large to ensure that M1 is capable of responding the load variations without moving out its desired region of operation. In this example, $I_{Q1}$ is selected as 1.5 mA. If, at some point, $I_L$ suddenly steps down to 2.5 mA, M1 reacts to the drop almost instantly (M1 is small and fast) and changes the value of $I_1$ from 1.5 mA to 0.5 mA. If this scenario remains stable (no other disturbances), second closed-loop 103 detects that $I_1$ has decreased, and, in response, reduces the value of $I_2$, albeit in a slower fashion (M2 is large). As the value of $I_2$ is reduced from 1.5 mA to 0.5 mA, the value of returns from 0.5 mA to 1.5 mA; where it stays until of the next step change of current $I_L$.

Figure 3:
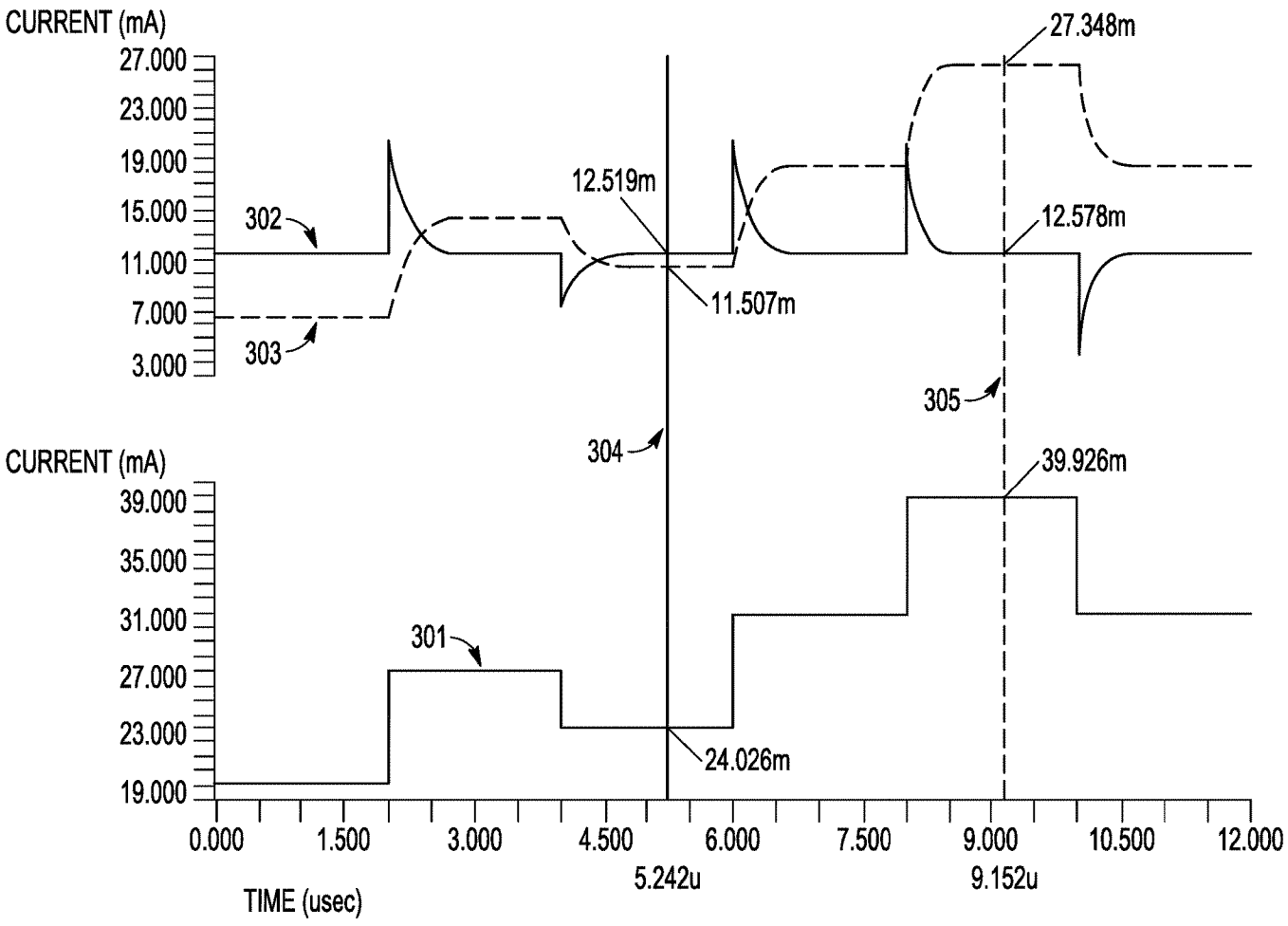
FIG. 3 is a graph illustrating, as an example, the manner in which various the currents involved in the operation of the LDO voltage regulator of FIG. 1 relate to one another according to some embodiments.

To better explain the foregoing, graph 300 of FIG. 3 illustrates, by way of another non-limiting example, the manner in which various currents involved in the operation of LDO regulator 200 relate to one another according to some embodiments. Curve 301 represents load current $I_L$, curve 302 represents M1's current $I_1$, and curve 303 represents M2's current $I_2$.

In this example, $I_{Q1}$ is set near 12.5 mA. It should be noted that, over time, second closed-loop 103 works to maintain (curve 302) at the same value as $I_{Q1}$; that is, approximately 12.5 mA. In the beginning, $I_L$ has a magnitude of approximately 20 mA. As such, $I_1$ provides approximately 12.5 mA and $I_2$ provides approximately 7.5 mA. At t=~2 μs, however, $I_L$ changes abruptly from approximately 20 mA to approximately 28 mA. In response, $I_1$ reacts immediately and jumps from approximately 12.5 mA to approximately 20.5 mA, while $I_2$ initially remains at approximately 7.5 mA. Between t=~2 μs and t=~3 μs, current $I_2$ is slowly raised from approximately 7.5 mA to approximately 15.5 mA, and drops from approximately 20.5 mA back to approximately 12.5 mA ($I_{Q1}$), all the while providing the same $I_L$ of approximately 28 mA.

Then, at t=~4 μs, $I_L$ drops abruptly from approximately 28 mA to approximately 24 mA. In response, $I_1$ reacts immediately and falls from approximately 12.5 mA to approximately 8.5 mA, while $I_2$ initially remains at approximately 15.5 mA. Between t=~4 μs and t=~5 μs, current $I_2$ is slowly reduced from approximately 15.5 mA to approximately 11.5 mA, and $I_1$ is raised from approximately 8.5 mA back to approximately 12.5 mA ($I_{Q1}$), all the while providing the same $I_L$ of approximately 24 mA. This is shown by marker 204, where, at t=5.242 μs, $I_L$=24.0 mA, $I_1$=12.5 mA, and $I_2$=11.5 mA.

At t=~6 μs, $I_L$ changes abruptly from approximately 24 mA to approximately 32 mA. In response, $I_1$ reacts immediately and jumps from approximately 12.5 mA to approximately 20.5 mA, while $I_2$ initially remains at approximately 11.5 mA. Between t=~6 μs and t=~7 μs, current $I_2$ is slowly raised from approximately 11.5 mA to approximately 19.5 mA, and $I_1$ drops from approximately 20.5 mA back to approximately 12.5 mA ($I_{Q1}$), all the while providing the same $I_L$ of approximately 32 mA.

At t=~8 μs, $I_L$ again changes abruptly from approximately 32 mA to approximately 40 mA. In response, $I_1$ reacts immediately and again jumps from approximately 12.5 mA to approximately 20.5 mA, while $I_2$ initially remains at approximately 19.5 mA. Between t=~8 μs and t=~9 μs, current $I_2$ is slowly raised from approximately 19.5 mA to approximately 27.5 mA, and $I_1$ drops from approximately 20.5 mA back to approximately 12.5 mA ($I_{Q1}$), all the while providing the same $I_L$ of approximately 40 mA. This is shown by marker 205, where, at t=9.2 μs, $I_L$=40.0 mA, $I_1$=12.6 mA, and $I_2$=27.3 mA.

Then, at t=~10 μs, $I_L$ drops abruptly from approximately 40 mA to approximately 32 mA. In response, $I_1$ reacts immediately and falls from approximately 12.5 mA to approximately 4.5 mA, while $I_2$ initially remains at approximately 27.5 mA. Between t=~10 μs and t=~11 μs, $I_2$ is slowly reduced from approximately 27.5 mA to approximately 19.5 mA, and $I_1$ is raised from approximately 4.5 mA back to approximately 12.5 mA ($I_{Q1}$), all the while providing the same $I_L$ of approximately 32 mA.

Referring back to FIG. 1, regulator 101 includes two pass-devices, M1 (small) and M2 (large), as well as two loop structures, fast closed-loop 102 (around M1) and slow closed-loop 103 (around M1 and M2). Fast closed-loop 102 around M1 monitors and reacts to the difference between the output voltage $V_{OUT}$ and a reference voltage $V_{REF}$. Slow closed-loop 103 around M1 and M2 monitors and reacts to difference between current $I_1$ (conducted by M1) and a reference current value $I_{Q1}$. That is, slow closed-loop 103 acts on load 101 while aiming to maintain constant the DC offset level of the current $I_1$ through M1 equal to $I_{Q1}$.

Fast closed-loop 102 has dominant pole at the output node. To make the non-dominant pole at gate of M1 appear at high frequencies, M1 is selected to be a small pass-device with low gate capacitance. In slow closed-loop 103, large pass-device M2 provides the main portion of current $I_L$ at high load current conditions. The dominant pole is placed internally at gate of M2, taking advantage of its high gate capacitance. In various embodiments, the capacitance at the gate of M2 is advantageously amplified by factor β (a design variable) as in the case depicted in FIG. 2. The non-dominant pole is at the output node, which is particularly fit for capacitor-less applications. Moreover, slow closed-loop 103 is only "turned on" if the low-frequency component of the load current rises above a threshold value ($I_L \geq I_{Q1}$).

Figure 4:
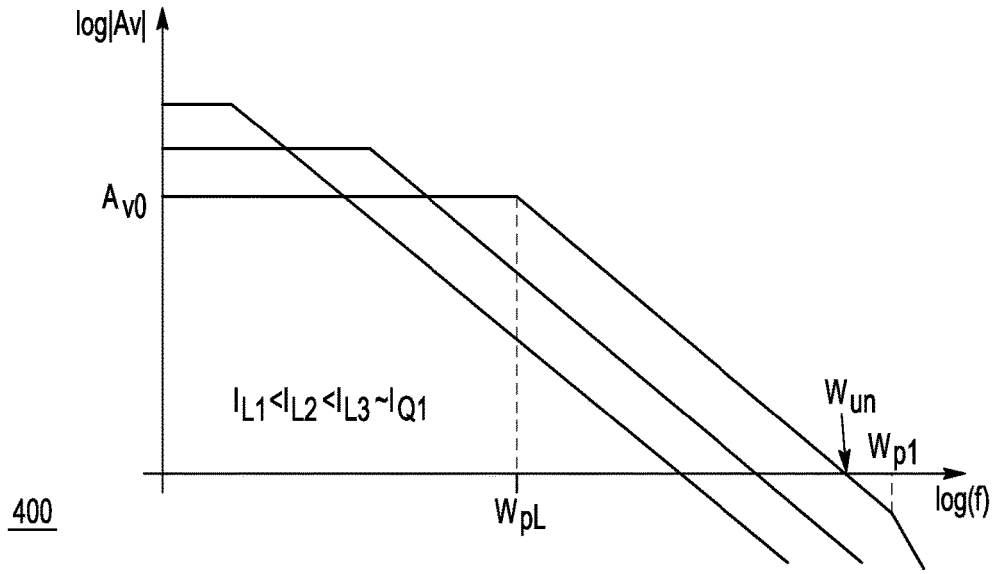
FIG. 4 is a graph illustrating an example of the frequency response of the LDO voltage regulator of FIG. 2 for a range of load currents $I_L$ greater than zero and smaller than reference or quiescent current $I_{Q1}$, according to some embodiments.

FIG. 4 is a graph illustrating an example of the behavior of LDO voltage regulator 200 for a range of load currents $I_L$ greater than zero and smaller than reference or quiescent current $I_{Q1}$, according to some embodiments. Particularly, graph 400 shows the loop gain as a function of frequency for three $I_L$ values $I_{L1}$, $I_{L2}$, and $I_{L3}$, such that $I_{L1}<I_{L2}<I_{L3}\sim I_{Q1}$.

In this example, loop 103 maintains M2 cut-off such that LDO regulator 200 behaves in the same manner that of a conventional LDO regulator with a single pass-device (M1) and dominant pole placed at output node. In this case, $A_{v0}$, $w_{pL}$, $w_{un}$, and $w_{p1}$ are given by the following expressions:

$$A_{v0}=G_{m0}\times R1\times g_{m1}\times RL$$

$$w_{pL}=1/(RL\times CL)$$

$$w_{un}=G_{m0}\times R1\times g_{m1}/CL$$

$$w_{p1}=1/(R1\times C1)$$

Where $A_{v0}$ is the DC loop gain, $w_{pL}$ is the frequency the first pole at node $V_{out}$, $w_{un}$ is the unity gain frequency, and $w_{p1}$ is the frequency of the non-dominant pole, associated with the gate terminal of pass device M1.

While $I_L<I_{Q1}$, slow closed loop 103 is turned off and has no effect on the operation of LDO regulator 200. As such, LDO regulator 200 behaves as a conventional LDO regulator that has a dominant pole at the output node. As $I_L$ rises (RL lowers), the transconductance $g_{m1}$ of pass device M1 increases. The DC loop gain $A_{v0}$ remains nearly constant while M1 operates in weak inversion ($g_{m1}\propto I_1$ and $RL\propto 1/IL$) and decreases when M1 operates in strong inversion ($g_{m1}\propto\sqrt{I_1}$ and $RL\propto 1/IL$). And the gain-bandwidth product $w_{un}$ increases with $g_{m1}$. Regulator 200 is designed to be stable within this load current range.

Figure 5:
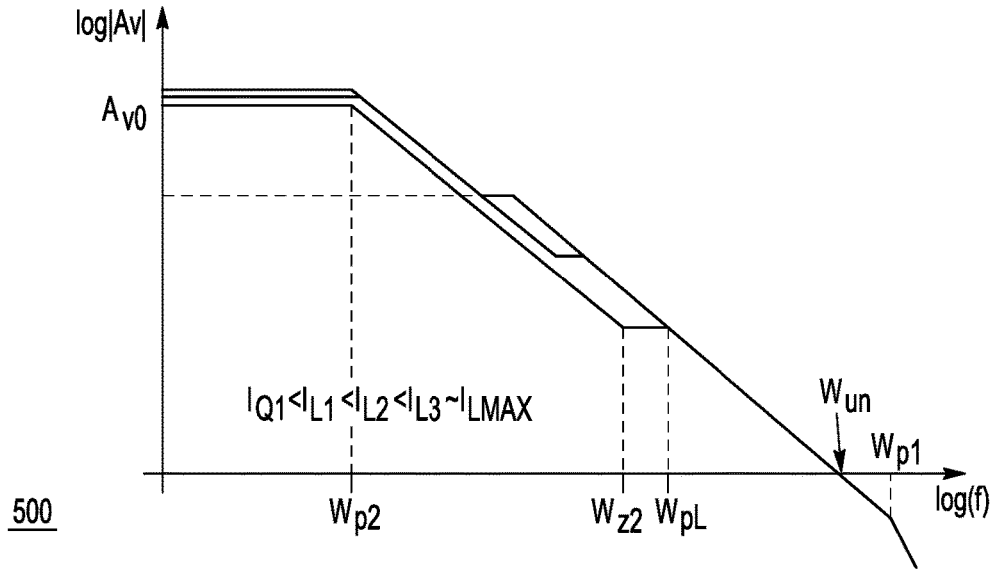
FIG. 5 is a graph illustrating an example of the frequency response of the LDO voltage regulator of FIG. 2 for a range of load currents $I_L$ greater than reference or quiescent current $I_{Q1}$, according to some embodiments.

FIG. 5 is a graph illustrating an example of the behavior of LDO voltage regulator 200 for a range of load currents $I_L$ greater than reference or quiescent current $I_{Q1}$, according to some embodiments, in which case loop 103 is turned on as has effect on the operation of the LDO regulator 200. Particularly, graph 500 shows the loop gain as a function of frequency for three $I_L$ values $I_{L1}$, $I_{L2}$, and $I_{L3}$, such that $I_{Q1}<I_{L1}<I_{L2}<I_{L3}\sim I_{LMAX}$.

In this example, $A_{v0}$, $w_{p2}$, $w_{z2}$, $w_{pL}$, $w_{un}$, and $w_{p1}$ are given by the following expressions:

$$A_{v0}=G_{m0}\times R1\times g_{m1}\times RL\times(1+g_{m2}\times(R2/\beta))$$

$$w_{p2}=1/(R2\times C2)$$

$$w_{z2}=G_{m2}/(\beta C2)$$

$$w_{pL}=1/(RL\times CL)$$

$$w_{un}=G_{m0}\times R1\times g_{m1}/CL$$

$$w_{p1}=1/(R1\times C1)$$

Where $A_{v0}$ is the DC loop gain, $w_{p2}$ is the frequency of a non-dominant pole associated with the gate of pass device M2, $w_{z2}$ is the frequency of a zero associated with the gate of pass device M2, $w_{pL}$ is the frequency the first pole at node $V_{out}$, $w_{un}$ is the unity gain frequency, and $w_{p1}$ is the frequency of another non-dominant pole associated with the gate terminal of pass device M1.

Graph 500 shows a performance boost when slow closed-loop 103 turns on, with an increase in DC gain on the extended current range. Slow closed-loop 103 maintains $I_1=I_{Q1}$ in low frequency, hence the transconductance $g_{m1}$ of pass device M1 is maintained constant. A constant $g_{m1}$ in turn results in a constant Gain-Bandwidth product. As load current $I_L$ rises, zero $w_{z2}$ tracks pole $w_{pL}$, both moving towards high frequency. Both move together while M2 operates in weak inversion. When M2 eventually goes into strong inversion (as $I_L$ rises), pole $w_{pL}$ moves faster towards higher frequency than zero $w_{z2}$. Also, DC loop gain $A_{v0}$ remains nearly constant if M2 operates in weak inversion ($g_{m2} \propto I_2$) and decreases if M2 operates in strong inversion ($g_{m2} \propto \sqrt{I_2}$). As such, this embodiment is stable over an extended load current range—that is, up to a selected $I_{LMAX}$, that is mainly determined by M2's maximum current capability.

Figure 6:
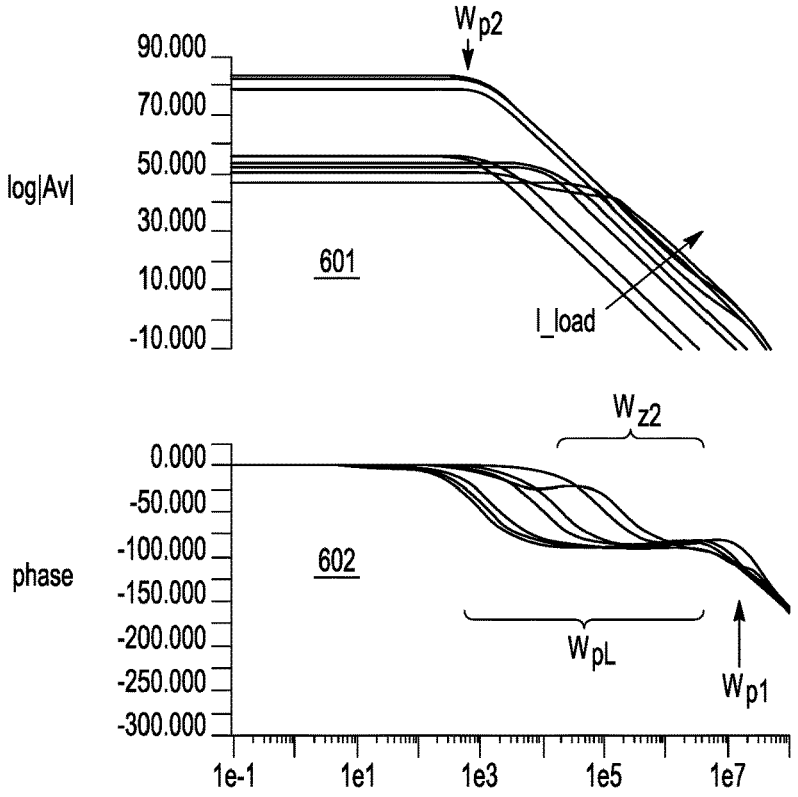
FIG. 6 shows a graph illustrating the frequency response of a simulated model of the LDO voltage regulator of FIG. 2 for a range of load currents, according to some embodiments.
Figure 7:
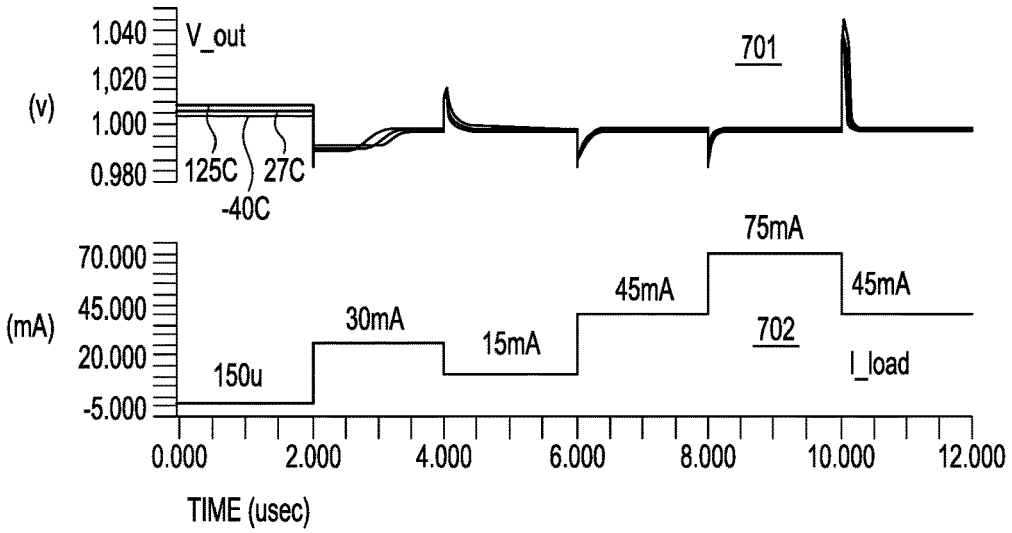
FIG. 7 shows graphs illustrating $V_{OUT}$ and $I_L$ for the simulated LDO voltage regulator of FIG. 2 for different operating temperatures, according to some embodiments.

FIG. 6 shows gain and phase graphs 601 and 602, respectively, illustrating the behavior of a simulated model of LDO voltage regulator 200 for a range of increasing load currents, according to some embodiments, and FIG. 7 shows graphs 701 and 702 illustrating $V_{OUT}$ and $I_L$ for LDO voltage regulator 200 for different operating temperatures (125° C., 27° C., and −40° C.). Graphs 601, 602, 701, and 702 show that circuit 200 is stable over a wide load range. In this simulation model, M1 has the following characteristics: W=40, L=0.44, and m=20, where W is the width, L is the length, and m is the number of transistors in parallel with each other. M2 has the following characteristics: W=40, L=0.44, and m=4 k; that is, it is effectively 200 times larger than M1. Further, R1 is 3 KΩ and R2 is 200 kΩ.

In various scenarios, reference current $I_{Q1}$ may not have a fixed value. For example, it may be beneficial to be able to program the magnitude of $I_{Q1}$ (i.e., by having) a couple of options for $I_{Q1}$) and to select its value during operation, or to generate $I_{Q1}$ as a function of some a different parameter (e.g., temperature). For instance, a circuit may detect if M2 is ON (loop 103 operational) or OFF and use that information to adjust the level of $I_{Q1}$. The system may also adjust $I_{Q1}$ based on some knowledge of the magnitude expected for the low and high-frequency components for each system operation mode, based on temperature, etc. Or the system may monitor the state of M2 (on or off) to auto-calibrate $I_{Q1}$. These features may be implemented digitally and/or analogically. In sum, the magnitude of $I_{Q1}$ may be fixed by design or configurable by system depending on the application.

Figure 8:
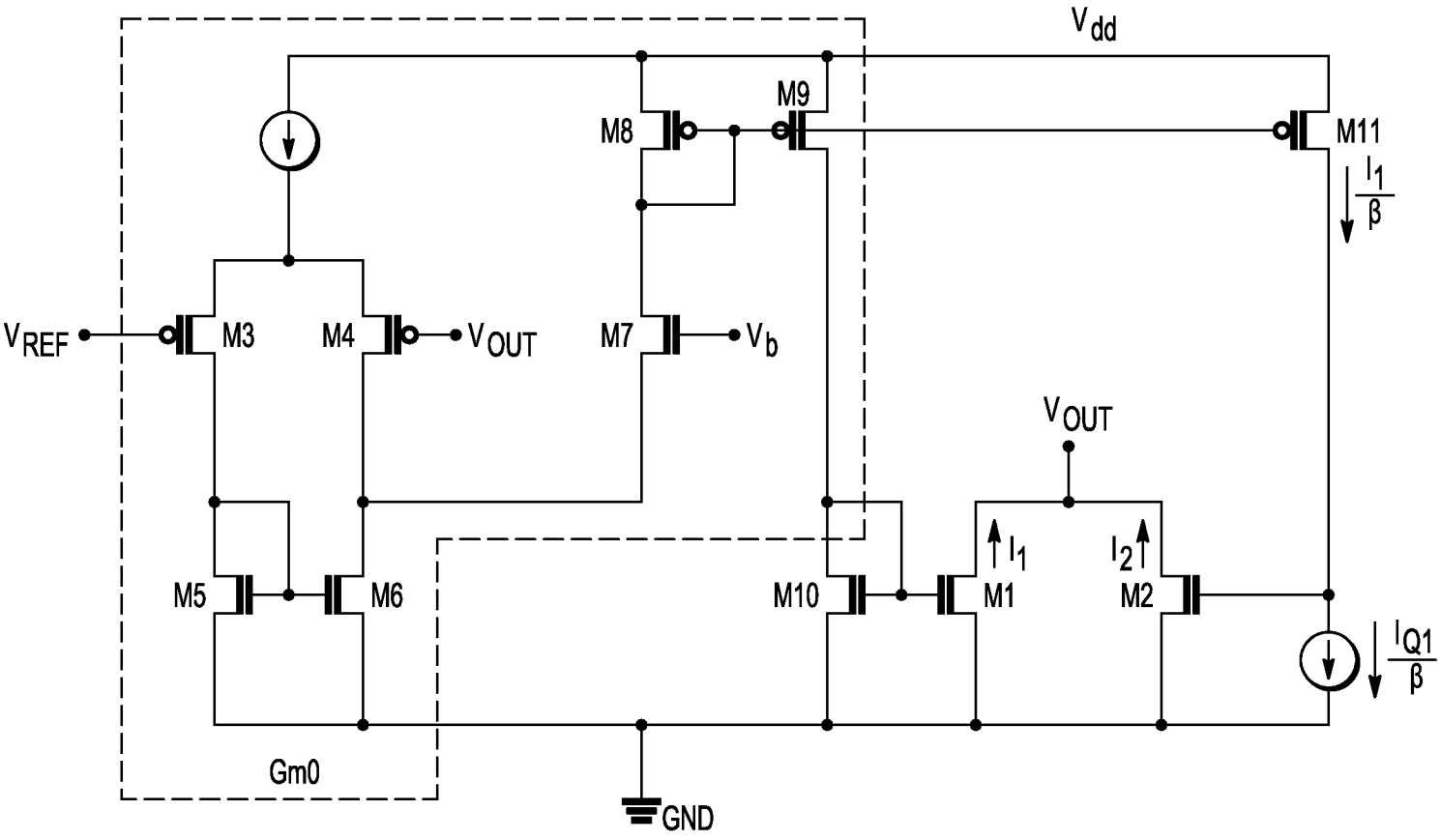
FIG. 8 is a circuit diagram of an example of an application of a LDO voltage regulator implementing the circuit of FIG. 2, according to some embodiments.

FIG. 8 is a circuit diagram of an example implementation of LDO voltage regulator 800, according to some embodiments. In this example, the low-dropout characteristic applies towards the ground rail and hence both pass devices M1 and M2 are NMOS transistors, showing possible the complementary approach previously mentioned. Loop 102 includes transistors M3-M10, coupled to each other as shown, and configured to receive the differential pair $V_{REF}$ and $V_{OUT}$. To implement loop 103, transistor M11 and M2, and current source providing current $I_{Q1}/\beta$ are added. Transistor M11 generates the scaled copy of M1's output current $I_1/\beta$.

For simulations, the sizes of the various transistors M1-M11 were set as follows: M1: W=10, L=0.08, m=400; M2: W=10, L=0.08, m=2 k; M3 and M4: W=20, L=0.8, m=80; M5 and M6: W=30, L=0.8, and m=40; M7: W=20, L=0.6, m=10; M8: W=20, L=0.4, m=1; M9: W=20, L=0.4, and m=10; M10: W=10, L=0.08, m=10; M11: W=5, L=0.4, m=1. Current $I_{Q1}/\beta$ was made equal to 25 μA. The tail current provided to the input pair was made equal to 1 mA and Vb voltage is such that it maintains surrounding transistors operating in the desired bias conditions.

Figure 9:
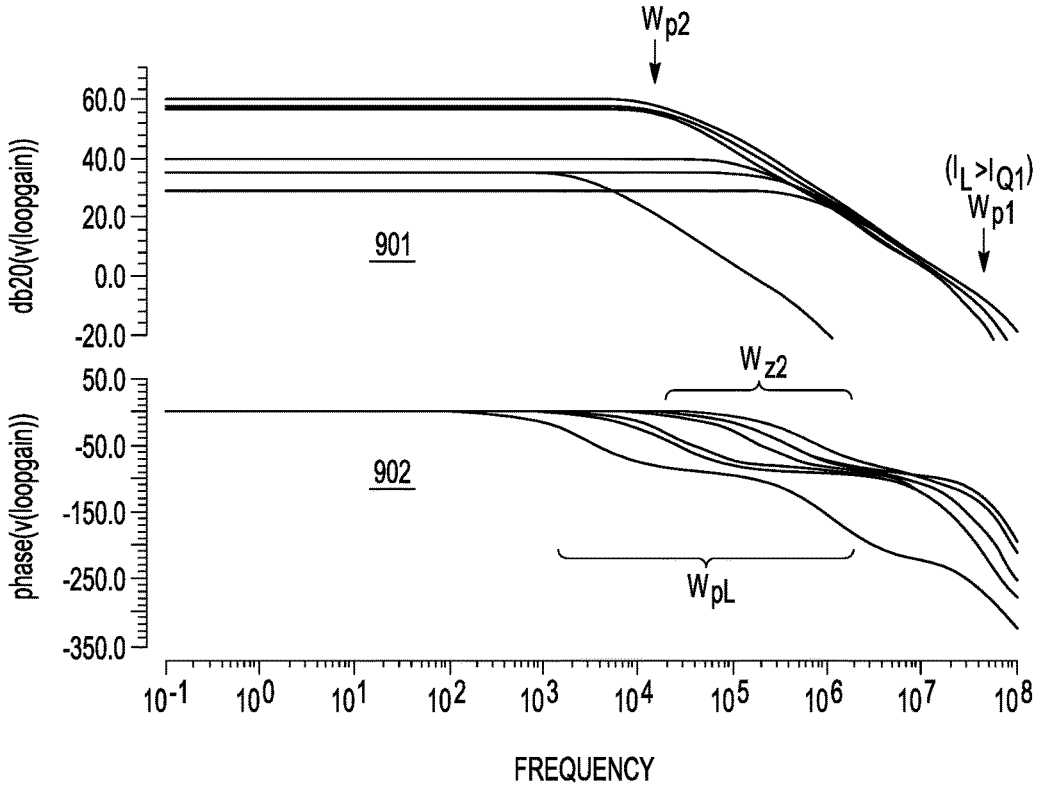
FIG. 9 shows a graph illustrating the behavior of the simulated LDO voltage regulator of FIG. 8 for a range of load currents, according to some embodiments.

FIG. 9 shows gain and phase graphs 901 and 902, respectively, illustrating the behavior of LDO voltage regulator 900 for a range of increasing load currents, according to some embodiments.

Figure 10:
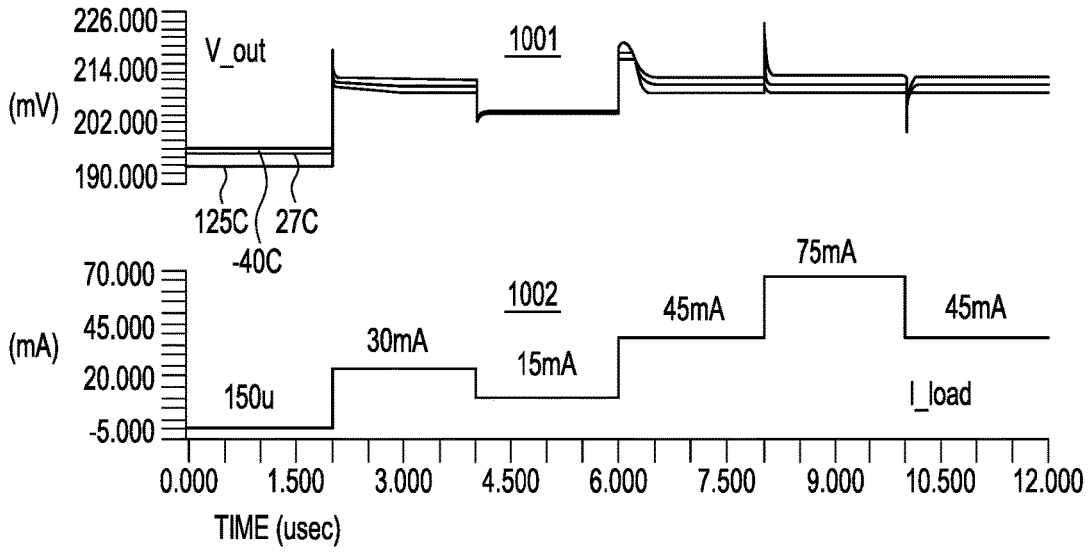
FIGS. 10-12 show graphs illustrating $V_{OUT}$ and $I_L$ for the simulated LDO voltage regulator of FIG. 8 for different ranges of $I_L$ and different operating temperatures, according to some embodiments.
Figure 11:
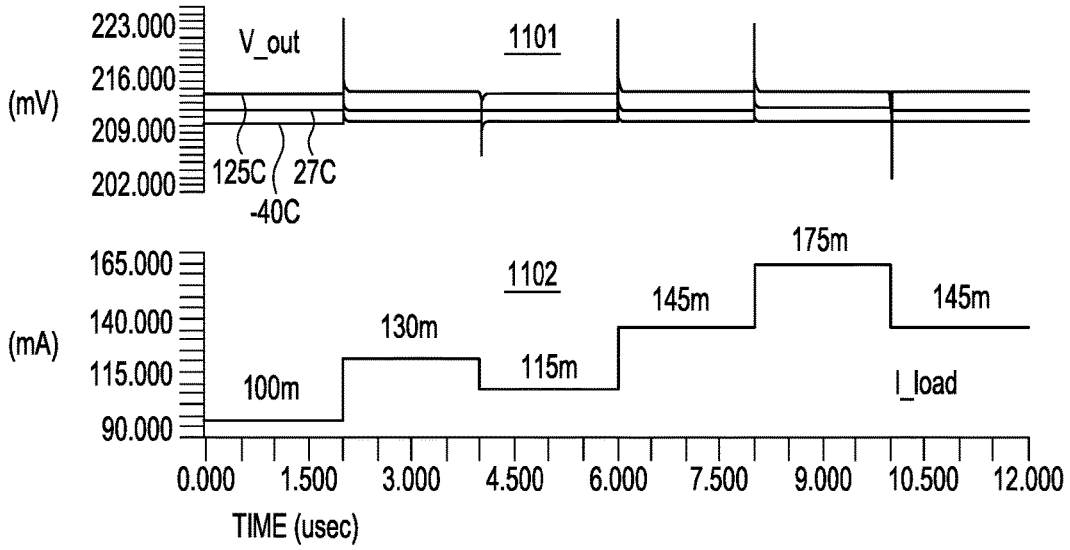
Figure 12:
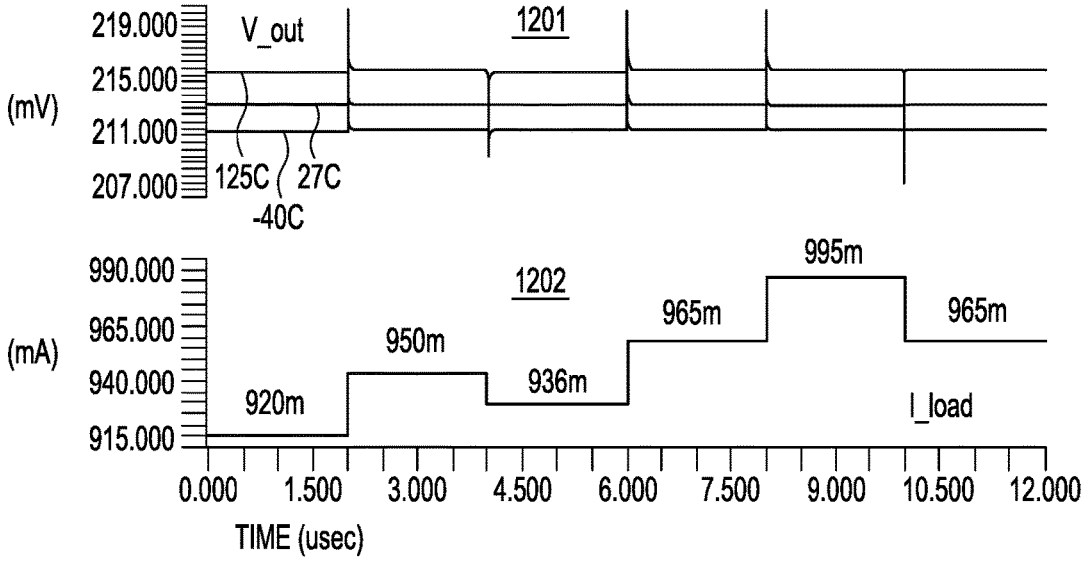

FIGS. 10-12 show graphs illustrating $V_{OUT}$ and $I_L$ for LDO voltage regulator 800 for different operating temperatures (125° C., 27° C., and −40° C.). Particularly, graphs 1001 and 1002 show $V_{OUT}$ and $I_L$ curves, respectively, for $I_L$ ranging between 150 μA and 75 mA. Graphs 1101 and 1102 show $V_{OUT}$ and $I_L$ curves, respectively, for $I_L$ ranging between 100 mA and 175 mA. And graphs 1201 and 1202 show $V_{OUT}$ and $I_L$ curves, respectively, for $I_L$ ranging between 920 mA and 995 mA. Here, Graphs 1001-1002, 1101-1102, and 1301-1302 show how circuit 800 reacts to variations as high as 30 mA instantaneous load current steps in various regions of the wide load current range supported.

In various embodiments, systems and methods described herein may provide an LDO voltage regulator that uses two pass-devices connected in parallel to an output node: a first pass-device M1 to supply high-frequency load current components, and a second pass-device M2 to supply low-frequency load current components. Techniques for control and frequency compensation are employed that are based on maintaining a fixed DC current level through the first pass-device by directing exceeding low-frequency load currents components to the second pass-device. Particularly, techniques discussed herein involve using two closed-loops with the purpose of providing fast transient response with improved power-efficiency over an extended load current range. Regulation is achieved by using a fast closed-loop 102 with a lower current capability associated with a slow closed-loop 103 with a higher current capability.

As described herein, in an illustrative, non-limiting embodiment, an electronic device may include a load; and a voltage regulator coupled to the load and configured to provide a load current, wherein the voltage regulator includes a first pass device and a second pass device coupled in parallel with each other and configured to operate simultaneously. The load current has a low-frequency component and a high-frequency component. The first pass device provides a first current corresponding to the high-frequency component, and wherein the second pass device provides a second current corresponding to the low-frequency component.

A control loop compares the magnitude of the first current to a magnitude of a reference current. The magnitude of reference current is greater than the peak magnitude of the high-frequency component. The control loop operates to maintain the magnitude of the low-frequency component equal to the magnitude of the reference current over time.

In response to an increase in the low-frequency component of the first current during operation, the control loop causes the magnitude of the second current to increase and causes the low-frequency component of the first current to decrease until the magnitude of the low-frequency component of the first current becomes equal to the magnitude of the reference current. In response to a decrease in the low-frequency component of the first current during operation, the control loop causes the magnitude of the second current to decrease and causes the low-frequency component of the first current to increase until the low-frequency component of the first current becomes equal to the magnitude of the reference current.

The control loop is configured to monitor the difference between the magnitude of the reference current and the magnitude of the low-frequency component of the first current generating as a result the control signal applied to a gate terminal of the second pass device, thereby controlling the magnitude of the second current.

In another illustrative, non-limiting embodiment, a method may include providing current to a load using a first pass device and a second pass device coupled in parallel with each other and configured to operate simultaneously in a voltage regulator, where the first pass device provides a first current corresponding to a high-frequency component of the load current and the second pass device provides a second current corresponding to a low-frequency component of the load current. In response to a decrease in a low-frequency component of the first current during operation, causing the second current to decrease and causing the low-frequency component of the first current to increase; and in response to an increase in the low-frequency component of the first current during operation, causing the second current to increase and causing the low-frequency component of the first current to decrease.

The method includes comparing the magnitude of the first current to a magnitude of a reference current via a control loop, causing the magnitude of the second current to be equal to the difference between a magnitude of the load current and the magnitude of the first current, and maintaining the magnitude of the low-frequency component of the first current equal to the magnitude of a reference current over time. The magnitude of reference current is greater than the peak magnitude of the high-frequency component.

In yet another illustrative, non-limiting embodiment, a voltage regulator includes a first pass device configured to output a first current; and a second pass device coupled in parallel with the first pass device and configured to output a second current simultaneously with the first current, wherein the first current provides a high-frequency portion of a load current, and wherein the second current provides a low-frequency portion of the load current.

A control loop compares the low-frequency component of the first current to a magnitude of a reference current. The control loop maintains the low-frequency component of the first current equal to the magnitude of the reference current over time. The control loop controls the magnitude of the second current by monitoring a difference between the magnitude of the reference current and the magnitude of the first current to generate a control signal configured to drive a gate terminal of the second pass device.

In response to an increase in the low-frequency component of the first current, the control loop causes the magnitude of the second current to increase and causes the magnitude of the low-frequency component of the first current to decrease until the magnitude of the low-frequency component of the first current becomes equal to the magnitude of the reference current. In response to a decrease in the low-frequency component of the first current, the control loop causes the magnitude of the second current to decrease and causes the magnitude of the low-frequency component of the first current to increase until the magnitude of the low-frequency component of the first current becomes equal to the magnitude of the reference current.

In many implementations, the systems and methods disclosed herein may be incorporated into a wide range of electronic devices including, for example, computer systems or Information Technology (IT) products such as servers, desktops, laptops, memories, switches, routers, etc.; telecommunications hardware; consumer devices or appliances such as mobile phones, tablets, television sets, cameras, sound systems, etc.; scientific instrumentation; industrial robotics; medical or laboratory electronics such as imaging, diagnostic, or therapeutic equipment, etc.; transportation vehicles such as automobiles, buses, trucks, trains, watercraft, aircraft, etc.; military equipment, etc. More generally, these systems and methods may be incorporated into any device or system having one or more electronic parts or components.

Although the invention(s) is/are described herein with reference to specific embodiments, various modifications and changes can be made without departing from the scope of the present invention(s), as set forth in the claims below. Accordingly, the specification and figures are to be regarded in an illustrative rather than a restrictive sense, and all such modifications are intended to be included within the scope of the present invention(s). Any benefits, advantages, or solutions to problems that are described herein with regard to specific embodiments are not intended to be construed as a critical, required, or essential feature or element of any or all the claims.

Unless stated otherwise, terms such as "first" and "second" are used to arbitrarily distinguish between the elements such terms describe. Thus, these terms are not necessarily intended to indicate temporal or other prioritization of such elements. The terms "coupled" or "operably coupled" are defined as connected, although not necessarily directly, and not necessarily mechanically. The terms "a" and "an" are defined as one or more unless stated otherwise. The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a system, device, or apparatus that "comprises," "has," "includes" or "contains" one or more elements possesses those one or more elements but is not limited to possessing only those one or more elements. Similarly, a method or process that "comprises," "has," "includes" or "contains" one or more operations possesses those one or more operations but is not limited to possessing only those one or more operations.

The invention claimed is:

1. An electronic device, comprising:

a load; and a voltage regulator coupled to the load and configured to provide a load current, wherein the voltage regulator includes a first pass device and a second pass device coupled in parallel with each other and configured to operate simultaneously, wherein:

the load current has a low-frequency component and a high-frequency component, the first pass device provides a first current corresponding to the high-frequency component, the second pass device provides a second current corresponding to the low-frequency component, and a control loop compares the magnitude of the first current to a magnitude of a reference current.

2. The electronic device of claim 1, wherein the magnitude of reference current is greater than the peak magnitude of the high-frequency component.

3. The electronic device of claim 1, wherein the control loop operates to maintain the magnitude of the low-frequency component equal to the magnitude of the reference current over time.

4. The electronic device of claim 3, wherein in response to an increase in the low-frequency component of the first current during operation, the control loop causes the magnitude of the second current to increase and causes the low-frequency component of the first current to decrease until the magnitude of the low-frequency component of the first current becomes equal to the magnitude of the reference current.

5. The electronic device of claim 3, wherein in response to a decrease in the low-frequency component of the first current during operation, the control loop causes the magnitude of the second current to decrease and causes the low-frequency component of the first current to increase until the low-frequency component of the first current becomes equal to the magnitude of the reference current.

6. The electronic device of claim 3, wherein the control loop is configured to monitor the difference between the magnitude of the reference current and the magnitude of the low-frequency component of the first current generating as a result the control signal applied to a gate terminal of the second pass device, thereby controlling the magnitude of the second current.

7. A method, comprising:

providing current to a load using a first pass device and a second pass device coupled in parallel with each other and configured to operate simultaneously in a voltage regulator, wherein the first pass device provides a first current corresponding to a high-frequency component of the load current and the second pass device provides a second current corresponding to a low-frequency component of the load current;

in response to a decrease in a low-frequency component of the first current during operation, causing the second current to decrease and causing the low-frequency component of the first current to increase; and in response to an increase in the low-frequency component of the first current during operation, causing the second current to increase and causing the low-frequency component of the first current to decrease; and comparing the magnitude of the first current to a magnitude of a reference current via a control loop.

8. The method of claim 7, further comprising causing the magnitude of the second current to be equal to the difference between a magnitude of the load current and the magnitude of the first current.

9. A method, comprising:

providing current to a load using a first pass device and a second pass device coupled in parallel with each other and configured to operate simultaneously in a voltage regulator, wherein the first pass device provides a first current corresponding to a high-frequency component of the load current and the second pass device provides a second current corresponding to a low-frequency component of the load current;

in response to a decrease in a low-frequency component of the first current during operation, causing the second current to decrease and causing the low-frequency component of the first current to increase; and in response to an increase in the low-frequency component of the first current during operation, causing the second current to increase and causing the low-frequency component of the first current to decrease; and maintaining the magnitude of the low-frequency component of the first current equal to the magnitude of a reference current over time.

10. The method of claim 9, wherein the magnitude of reference current is greater than the peak magnitude of the high-frequency component.

11. A voltage regulator, comprising:

a first pass device configured to output a first current; and a second pass device coupled in parallel with the first pass device and configured to output a second current simultaneously with the first current, wherein the first current provides a high-frequency portion of a load current, and wherein the second current provides a low-frequency portion of the load current, wherein a control loop compares the low-frequency component of the first current to a magnitude of a reference current.

12. The voltage regulator of claim 11, wherein the control loop maintains the low-frequency component of the first current equal to the magnitude of the reference current over time.

13. The voltage regulator of claim 11, wherein the control loop controls the magnitude of the second current by monitoring a difference between the magnitude of the reference current and the magnitude of the first current to generate a control signal configured to drive a gate terminal of the second pass device.

14. The voltage regulator of claim 13, wherein in response to an increase in the low-frequency component of the first current, the control loop causes the magnitude of the second current to increase and causes the magnitude of the low-frequency component of the first current to decrease until the magnitude of the low-frequency component of the first current becomes equal to the magnitude of the reference current.

15. The voltage regulator of claim 13, wherein in response to a decrease in the low-frequency component of the first current, the control loop causes the magnitude of the second current to decrease and causes the magnitude of the low-frequency component of the first current to increase until the magnitude of the low-frequency component of the first current becomes equal to the magnitude of the reference current.

* * * * *